United States Patent [19]

Merlo

[11] Patent Number: 4,755,102

[45] Date of Patent: Jul. 5, 1988

[54] FORK-LIFT TRUCK

[75] Inventor: Amilcare Merlo, Cuneo, Italy

[73] Assignee: Merlo S.p.A. Industria Metalmeccanica, San Defendente di Cervasca (Cuneo), Italy

[21] Appl. No.: 911,294

[22] Filed: Sep. 24, 1986

[30] Foreign Application Priority Data

Oct. 1, 1985 [IT] Italy ..... 53876/85[U]

[51] Int. Cl.[4] ..... B66C 23/00

[52] U.S. Cl. ..... 414/692; 74/103; 74/520; 414/690; 414/691

[58] Field of Search ..... 414/685, 687, 690, 691, 414/692, 705, 718, 723, 728; 212/184, 186, 204, 230, 231; 254/122, 93 R; 74/103, 106, 520

[56] References Cited

U.S. PATENT DOCUMENTS

| | | | |
|---|---|---|---|
| 2,569,354 | 9/1951 | Tracy | 74/103 X |
| 4,179,010 | 12/1979 | Ashworth | 212/231 X |
| 4,257,725 | 3/1981 | Zieschang | 414/723 X |
| 4,382,743 | 5/1983 | Newell | 414/718 X |
| 4,583,907 | 4/1986 | Wimberley | 414/718 |

FOREIGN PATENT DOCUMENTS

| | | | |
|---|---|---|---|
| 656181 | 1/1963 | Canada | 414/718 |
| 200105 | 11/1986 | European Pat. Off. | 901/14 |

*Primary Examiner*—Leslie J. Paperner
*Assistant Examiner*—Jennifer Doyle

[57] ABSTRACT

In a fork-lift truck comprising a wheeled structure carrying a lifting arm with a first part articulated at its rear end to the structure and a second part projecting downwardly from the front end of the first part and carrying a forked loading platform, and a jack for raising and lowering the arm, the lifting arm is supported by the wheeled structure so as to be orientable about a substantially vertical axis and two adjacent caliper units located in a general V configuration are provided to move the forked platform linearly relative to the lifting arm. Each caliper unit includes two plates having one mutual hinged articulation end and opposite articulation ends respectively hinged to the second part of the lifting arm and to the forked platform, the hinged articulations of the caliper units having respective axes which diverge downwardly and are substantially perpendicular to each other. Actuators are interposed between the two plates of each caliper unit for opening and closing them simultaneously.

6 Claims, 4 Drawing Sheets

FORK-LIFT TRUCK

The present invention relates to fork-lift trucks of the type comprising a wheeled structure carrying a lifting arm with a first part articulated at its rear end to the structure and a second part projecting downwardly from the front end of the first part and carrying a forked loading platform, and in which there are provided means for raising and lowering the arm and means for effecting linear movements of the forked platform towards and away from the arm.

The object of the present invention is to provide a lift truck of the type specified above which is arranged to ensure that it is more efficient and more convenient to use than conventional lift trucks of this type.

According to the invention, this object is achieved by virtue of the fact that the lifting arm is supported by the wheeled structure so as to be orientable about a substantially vertical axis, and that the means for effecting linear movements of the forked platform relative to the arm include two adjacent caliper units located in a general V configuration and each including two plates having one mutual hinged articulation end and opposite articulation ends respectively hinged to the second part of the arm and to the forked platform, the hinged articulations of the caliper units having respective axes which diverge downwardly and are substantially perpendicular to each other, and actuator means interposed between the two plates of each caliper unit for opening and closing them simultaneously.

By virtue of this characteristic, the lift truck according to the invention has considerable operational flexibility in that the possibility of rotation of the lifting arm enables loads disposed even at the side or rear of the wheeled structure to be manipulated easily. Moreover, the means for effecting the linear movements of the forked platform relative to the arm are particularly compact and strong, as well as being relatively simple and cheap to manufacture and maintain.

The hinged articulations between the two caliper units and the second part of the arm are, to advantage, carried by a support connected to the second part so as to be pivotable about a substantially horizontal axis, and actuator means are interposed between the support and the second arm to pivot the two caliper units and hence the forked platform about this axis.

Figure 1:
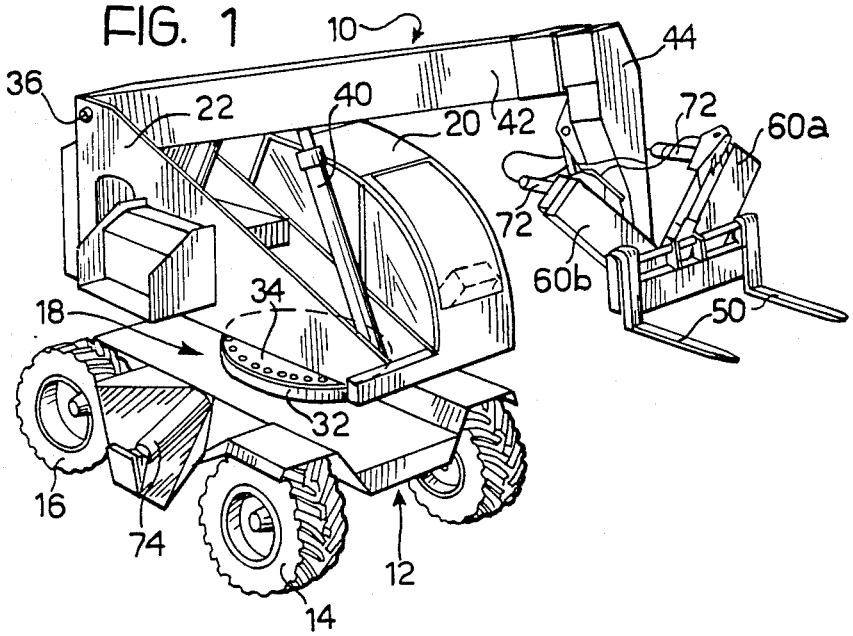
Figure 2:
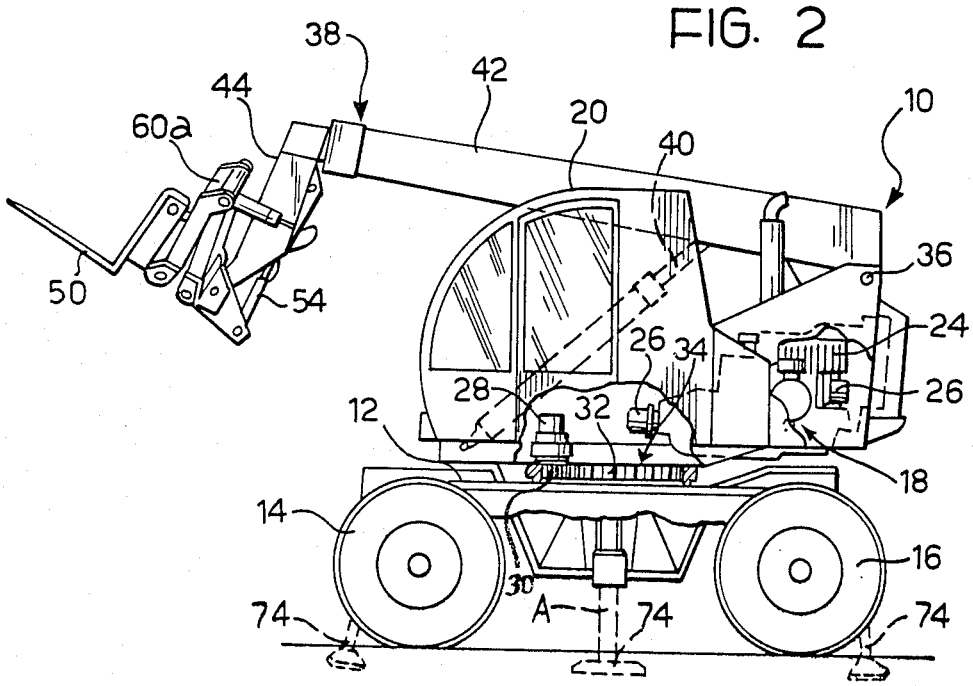
Figure 3:
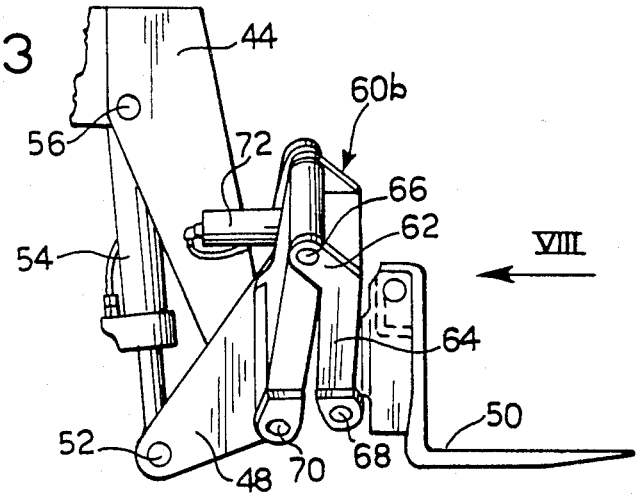
Figure 4:
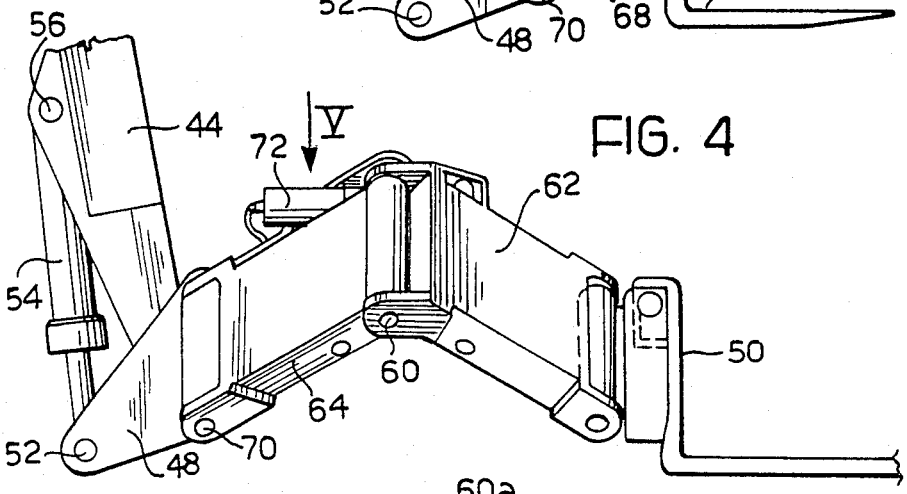
Figure 5:
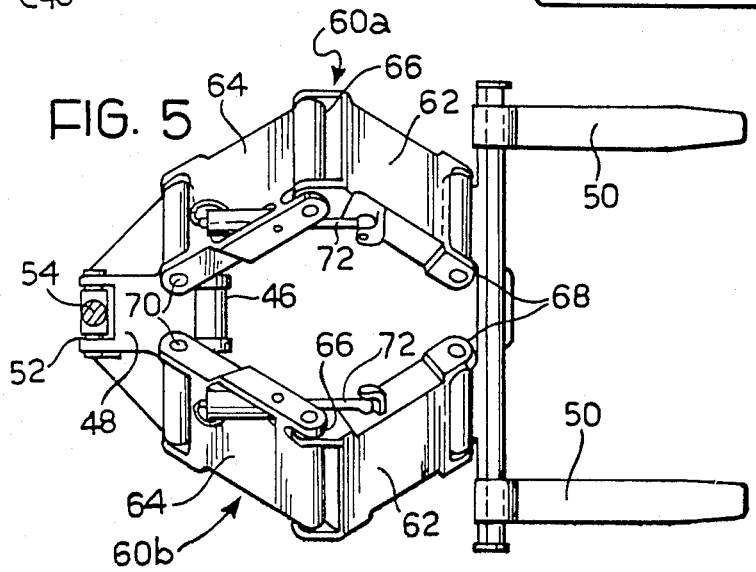
Figure 6:
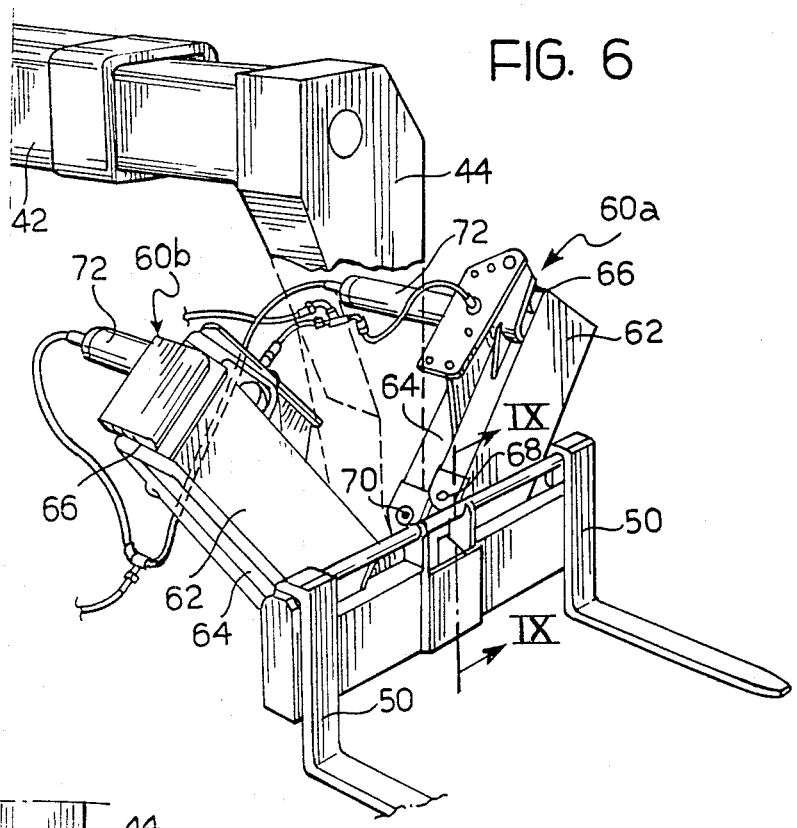
Figure 7:
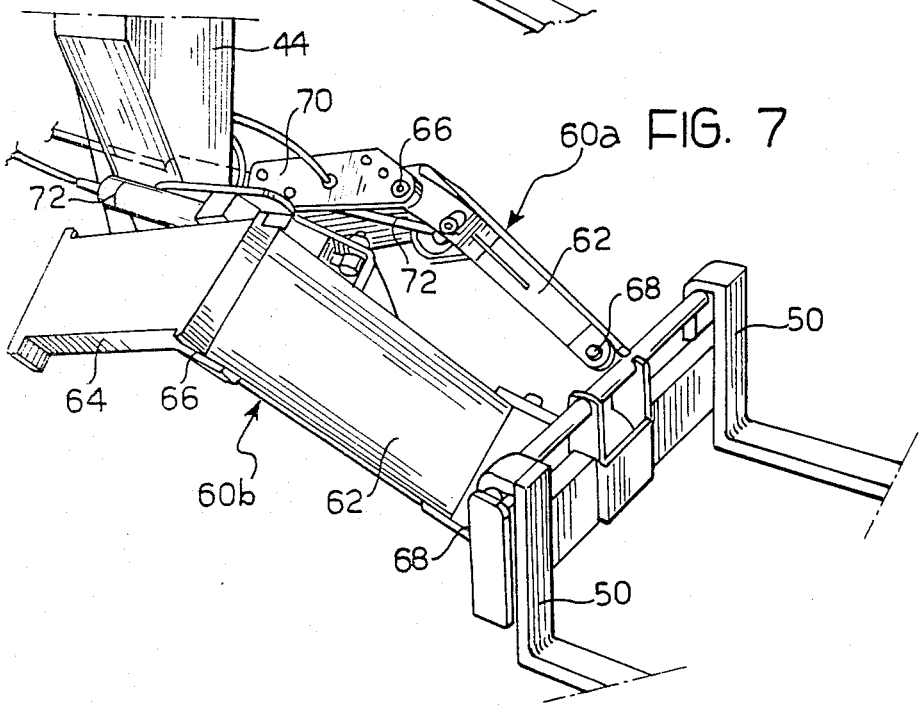
Figure 8:
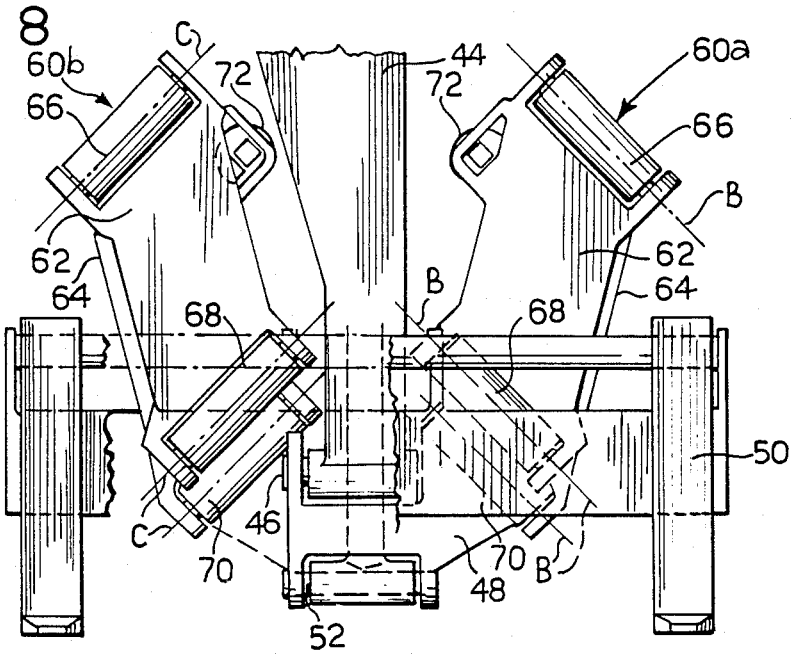
Figure 9:
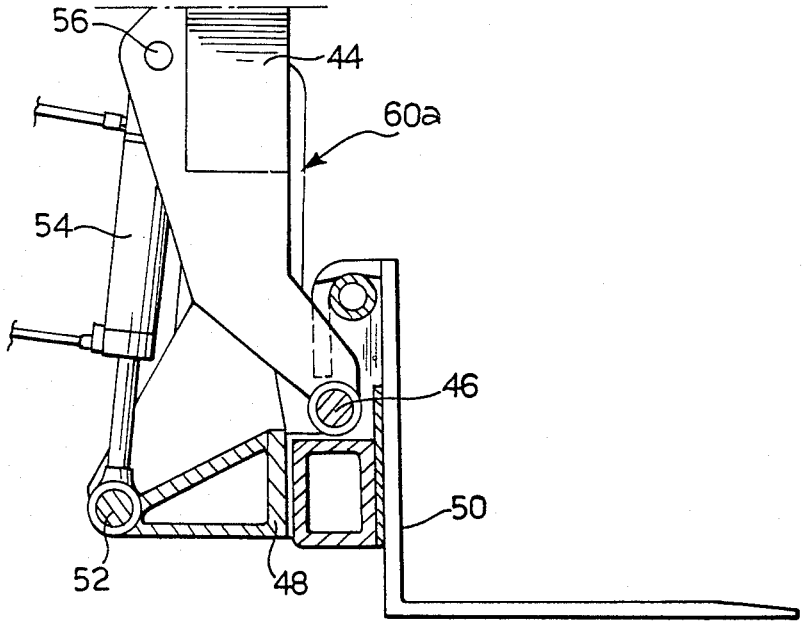

Further characteristics of the invention will become apparent during the detailed description which follows with reference to the appended drawings, provided purely by way of non-limiting example, in which:

FIG. 1 is a schematic perspective view of a fork-lift truck according to the invention, FIG. 2 is a partially-sectioned side elevational view of FIG. 1, FIG. 3 illustrates a detail of FIG. 2 on an enlarged scale and in a first operating condition, FIG. 4 is a view similar to FIG. 3, of the same detail in a second operating condition, FIG. 5 is a plan view taken on the arrow V of FIG. 4, FIG. 6 is a perspective view of FIG. 3, FIG. 7 is a perspective view of FIG. 4, FIG. 8 is a front elevational view taken on the arrow VIII of FIG. 3, and FIG. 9 is a section taken on the line IX—IX of FIG. 6.

With reference initially to FIGS. 1 and 2, a lift truck according to the invention is generally indicated 10 and includes a platform support structure 12 having front and rear wheels 14,16 respectively, and a turret structure 18 supported by the platform 12 so as to be rotatable about a vertical axis A.

The turret structure 18 carries a driver's cab 20 and, alongside this, a framework 22 carrying an internal combustion engine 24 for propelling the truck and for driving hydraulic pumps 26 for operating the various hydraulic apparatus which will be described below.

This apparatus includes a hydraulic motor 28 carried by the turret structure 18 and driving a pinion 30 which meshes with a gear 12 formed on the periphery of a centre plate 34 with two rings of balls through which the structure 18 is rotatably supported by the platform structure 12.

A lifting arm, generally indicated 38, driven by a hydraulic jack 40 is articulated to the rear part of the framework 22 about a horizontal pin 36.

The lifting arm 38 includes a longer part 42 and a shorter part 44 bent downwardly at right angles relative to the longer part 42 and telescopically slidable relative to the front end thereof, as is best seen in FIG. 6.

The lower end of the part 44 carries a transverse pin 46, best seen in FIGS. 5, 8 and 9, about which is articulated a generally fork-shaped support 48 carrying, in a manner which will be explained below, a forked platform 50. The support 48 carries a pin 52 disposed parallel to and behind the pin 46, to which is articulated the lower end of a hydraulic jack 54 whose upper end is articulated at 56 to the part 44. It will be apparent that the actuation of the jack 54 causes a corresponding pivoting of the support 48, and hence of the forked platform 50, about the axis of the pin 46.

A hydraulically-operated device is interposed between the support 48 and the forked platform 50 for effecting linear movements of the forked platform 50 towards and away from the part 44 of the lifting arm 42. This device, illustrated in detail in FIGS. 3 to 8, is constituted essentially by two adjacent caliper units **60*a*, 60*b*** located in a general V configuration.

Each of the two caliper units **60*a*, 60*b* is constituted by a front plate 62 and a rear plate 64 articulated together at one end by means of an intermediate hinge 66 and articulated at their opposite ends to the forked platform 50, by means of a frontal hinge 68, and to the support 48, by means of a dorsal hinge 70**, respectively.

The two pairs of plates 62 and 64 are inclined so that the axes of the hinges 66, 68 and 70, indicated B for the unit **60*a* and C for the unit 60*b* in FIG. 8, diverge downwardly and are at an angle of about 90° to each other, with the part 44** located substantially along the bisector of this angle.

The two caliper units **60*a*, 60*b* have respective hydraulic actuators for simultaneously opening and closing them. These actuators are constituted by two hydraulic jacks 72 interposed between the plates 62 and 64** on the inner sides thereof.

In the contracted condition of the jacks 72 illustrated in FIGS. 3 and 6 to 9, the plates 62 and 64 of the two units are closed together and the forked platform 50 is located at the minimum distance from the part 44 of the lifting arm 42. The extension of the two jacks 72 from this condition causes the two pairs of plates 62 and 64 to open and consequently moves the forked platform 50 away from the part 44 as far as the maximum distance illustrated in FIGS. 4, 5 and 7. It should be noted that, during the movement from the closed condition to the opened position and vice versa, the intermediate hinges 66 are always at a higher level than the frontal hinges 68 and the dorsal hinges 70.

The linear translation of the forked platform 50 in the manner described above, together with the possibility of pivoting of the platform 50 about the pin 46 and the possibility of orientation of the lifting arm 42 about the vertical axis A, ensures a flexibility of operation of the truck according to the invention which is considerably greater than that of conventional trucks. In effect, the platform 50 is able to operate in zones to which access is difficult for the wheeled structure 12, even to the side and rear of the latter.

In order to ensure the unnecessary stability of the truck 10 during rotations of the lifting arm 42 with a load on the platform 50, there is provided a series of hydraulic rests 74 (FIG. 2) carried by the structure 12 and lowerable into contact with the ground.

Naturally, the scope of the present invention extends to models which achieve equal utility by using the same innovative concept.

What is claimed is:

1. A fork-lift truck comprising a wheeled structure carrying a lifting arm with a first part articulated at its rear end to the structure and a second part projecting downwardly from the front end of the first part, a forked loading platform carried by said second part, means for raising and lowering the arm, and means for effecting linear movements of the forked platform towards and away from the arm, wherein the lifting arm is supported by the wheeled structure so as to be orientable about a substantially vertical axis, and wherein the means for effecting linear movements of the forked platform relative to the arm include two adjacent caliper units located in a general V configuration and each including two plates having one mutual hinged articulation end and opposite articulation ends respectively hinged to the second part of the lifting arm and to the forked platform, the hinged articulations of the caliper units having respective axes which diverge downwardly and are substantially perpendicular to each other, and actuator means interposed between the two plates of each caliper unit for opening and closing them simultaneously.

2. A truck according to claim 1, wherein the hinged articulations between the two plates of each caliper unit are located at a higher level than the hinged articulations between the plates and the forked platform and the second part of the lifting arm, respectively.

3. A truck according to claim 1, wherein the hinged articulations between the two caliper units and the second part of the lifting arm are carried by a support connected to the second part so as to be pivotable about a substantially horizontal axis, and wherein a linear hydraulic actuator is interposed between the second part and the support for pivoting the two caliper units about this axis.

4. A truck according to claim 1, wherein the actuator means for opening and closing the plates of the two caliper units simultaneously are constituted by two linear hydraulic actuators interposed between the plates.

5. A truck according to claim 1, wherein the lifting arm is articulated to a turret structure supported by the wheeled structure through a ball-bearing centre plate having a peripheral ring gear which meshes with a pinion rotated by a hydraulic motor carried by the turret structure.

6. A truck according to claim 1, wherein the wheeled structure has hydraulic members for bearing on the ground.

* * * * *

UNITED STATES PATENT AND TRADEMARK OFFICE

CERTIFICATE OF CORRECTION

PATENT NO. : 4,755,102

DATED : July 5, 1988

INVENTOR(S) : Amilcare Merlo

It is certified that error appears in the above-identified patent and that said Letters Patent are hereby corrected as shown below:

On the title page:

Item [30] "53876/85" should be -- 53876 B 85 --

Col. 2 line 14, "12" should be -- 32 --

Col. 3 line 15, "unnecessary" should be -- necessary --

Signed and Sealed this

Twenty-second Day of November, 1988

*Attest:*

DONALD J. QUIGG

*Attesting Officer*

*Commissioner of Patents and Trademarks*